US006038710A

United States Patent [19]

Baron

[11] Patent Number: 6,038,710

[45] Date of Patent: Mar. 21, 2000

[54] SEWAGE REMOVAL SYSTEM

[75] Inventor: Mark J. Baron, Manotick, Canada

[73] Assignee: Cowater International Inc., Ontario, Canada

[21] Appl. No.: 08/454,596

[22] Filed: May 30, 1995

Related U.S. Application Data

[63] Continuation-in-part of application No. 08/218,178, Mar. 28, 1994, abandoned.

[51] Int. Cl.[7] ..... E03D 1/00

[52] U.S. Cl. ..... 4/321; 4/322

[58] Field of Search ..... 4/316, 321, 322, 4/323, 431, 432, 433

[56] References Cited

U.S. PATENT DOCUMENTS

| | | | |
|---|---|---|---|
| 3,536,196 | 10/1970 | Zeff et al. | 4/322 X |
| 3,730,884 | 5/1973 | Burns et al. | 4/321 X |
| 4,713,847 | 12/1987 | Oldfelt et al. | 4/316 |
| 5,100,266 | 3/1992 | Ushitora et al. | 4/321 X |
| 5,186,354 | 2/1993 | Coffey et al. | 220/720 |
| 5,214,807 | 6/1993 | Terve | 4/321 |
| 5,282,281 | 2/1994 | Clear et al. | 4/434 |

FOREIGN PATENT DOCUMENTS

| | | | |
|---|---|---|---|
| 0057087 | 8/1982 | European Pat. Off. | 4/321 |
| 1661023 | 7/1991 | U.S.S.R. | 4/321 |
| 92/18713 | 10/1992 | WIPO | 4/322 |

*Primary Examiner*—Robert M. Fetsuga
*Attorney, Agent, or Firm*—Dickstein Shapiro Morin & Oshinsky LLP

[57] ABSTRACT

A sewage removal system for low water use toilets within an insulated building, the system comprising a transfer tank to collect sewage by gravity from the toilet, a holding tank remote from the transfer tank, a sewage discharge pipe extending between the transfer tank and the holding tank for fluid communication between the transfer tank and the holding tank, the sewage discharge pipe rising to a point, along its length, which is significantly above the fluid level in each of the transfer tank and the holding tank, a vent pipe for the interior of the holding tank and blower associated with the vent pipe, when activated to create a sufficient vacuum within the holding tank to draw sewage from the transfer tank, through the discharge pipe, into the holding tank, and a switch associated with the transfer tank and arranged so as to activate the blower, when the level of the sewage in the transfer tank rises to a predetermined height and to deactivate the blower when that level falls to a predetermined height. This system avoids the requirement for valves, pumps or other mechanical devices for removal of sewage from the building to a remote holding tank through the use of pneumatics. The holding tank may be higher, lower or on the same level as the transfer tank.

8 Claims, 1 Drawing Sheet

SEWAGE REMOVAL SYSTEM

This is a continuation-in-part of U.S. patent application Ser. No. 08/218,178 filed Mar. 28, 1994, abandoned.

FIELD OF THE INVENTION

The present invention relates to a sewage removal system for low-water-use toilets preferably situated within an insulated building.

BACKGROUND OF THE INVENTION

Particularly in cold environments, the collection and removal of sewage from houses, offices and other such buildings may present serious problems. In polar regions and other regions experiencing long periods of below freezing temperatures, conventional sewage removal systems incorporating pipes extending from buildings to a central treatment plant are often not practical, because of the problem of sewage freezing in the pipes. Where permafrost extends to a significant depth, the laying of sewage pipes becomes impractical or very expensive.

In recent times, sewage collection systems have been developed for buildings whereby sewage from toilets and other plumbing fixtures is fed to a holding tank for periodic removal by an external, sewage haul tank. Holding tanks may be inside the building, under the building or along side the building. One such tank is described and illustrated in U.S. Pat. No. 5,186,354 issued Feb. 16, 1993.

The relatively low flooring frequently found in housing in such polar areas, where the house rests on blocks or other such foundation on top of the permafrost, presents its own problems for sewage removal, since gravity flow of sewage to an inside or outside holding tank becomes impractical. As well, many of the conventional mechanical devices for handling sewage in more temperate climates, such as pumps, are prone to freezing and other forms of failure when subjected to the rigors of operating in extremely cold conditions with sewage fluids which may be of somewhat high viscosity. Such problems are compounded with low-water-use toilets because of the high solids ratio in the sewage.

As well, such conventional mechanical devices often require multiple valves for assisting in removal of the sewage from a toilet area to a holding tank area. Many such valves, of necessity, would be outside the insulated toilet area and hence, in an arctic environment, prone to seizing or other forms of mechanical failure. Thus, for instance, Soviet Union Patent No. 1,661,023 of Kalinin (July, 1991) which teaches a system of sewage removal for a toilet area to a holding tank on a train, requires multiple valves and would be entirely inappropriate and impractical for the harsh climatic conditions for which the present invention is intended.

Other known sewage removal systems require a standing vacuum condition in at least a portion of the system, for proper operation. Thus, for example, U.S. Pat. No. 4,713,824 of Oldfeldt, et al (December, 1987) teaches a vacuum toilet system where a standing vacuum in a part of the system is periodically accessed to draw waste from a toilet bowl. In a similar fashion, Ushitora, et al U.S. Pat. No. 5,100,266 (March, 1992) and Clear, et al U.S. Pat. No. 5,282,281 (February, 1994) teach sewage removal systems where parts of the systems are subjected to continuous or standing vacuum conditions in the line, with appropriate valve means and controls opening portions of the systems to the standing vacuum conditions for removal of sewage. Not only do such systems also require numerous and sophisticated valves, unsuitable for arctic conditions for reasons previously indicated, they also require relatively sophisticated vacuum generation and vacuum holding means. When it is considered that the system of the present invention is intended to be installed and operated in remote regions, where skilled trades people for installation and maintenance of the system may be unavailable for long periods at a time, it is again clear that such a system would be completely unsuitable for operation in the environment for which the present invention is intended.

It is an object of the present invention to provide a practical sewage removal system for low water use toilets in buildings in polar or cold climates. It is a further objective of the present invention to provide such a system which is inexpensive and practical to install, and reliable in operation.

It is a further object of the present invention to provide a system which will reduce the risk of freezing of sewage in pipes of the system, when the system is used in extreme, cold climates.

It is a further object of the present invention to provide such a sewage removal system which requires only low technology components, is virtually valve-free, and requires no standing vacuum conditions, for improved operation in environments of extreme cold and for ease of installation and maintenance in remote regions where skilled trades people may not be available.

SUMMARY OF THE INVENTION

In accordance with the present invention there is provided a sewage removal system for low water use toilets. The system comprises a transfer tank to collect sewage from the toilet and other plumbing fixtures. A holding tank is located at a position remote from the transfer tank. A sewage discharge pipe extends between the transfer tank and holding tank for fluid communication between the transfer tank and the holding tank. It rises to a point, along its length, which is significantly above the fluid level in each of the transfer tank and holding tank. The system further comprises a vent pipe for the interior of the holding tank. A blower is associated with the vent pipe, which when activated creates a sufficient vacuum within the holding tank to draw sewage from the transfer tank, through the discharge pipe, into the holding tank. A switch is provided with the transfer tank and is arranged so as to activate the blower, when the level of the sewage in the transfer tank rises to a predetermined height and to deactivate the blower when that level falls to a predetermined height.

In a preferred embodiment of the present invention for use in very cold climates, the vent pipe passes through the building and the blower is located within the building. This arrangement allows the blower to function at room temperature and protects it from danger of freezing. As well, the sewage discharge pipe extends from a position near the floor in the transfer tank to an elevated position within the holding tank.

The sewage removal system in accordance with the present invention, by working entirely on pneumatics, avoids the requirement for pumps, valves or other mechanical devices for removal of sewage from the building to a remote holding tank. Furthermore, because of the pneumatic collection of sewage in that holding tank, the holding tank need not be positioned for gravity feed below the transfer tank and plumbing fixtures, a significant advantage for low floor housing found in polar regions. Indeed, the holding tank may be at the same level as the transfer tank, or higher.

BRIEF DESCRIPTION OF THE DRAWINGS

These and other objects and advantages of the invention will become apparent upon reading the following detailed description and upon referring to the drawings in which.

Figure 1:
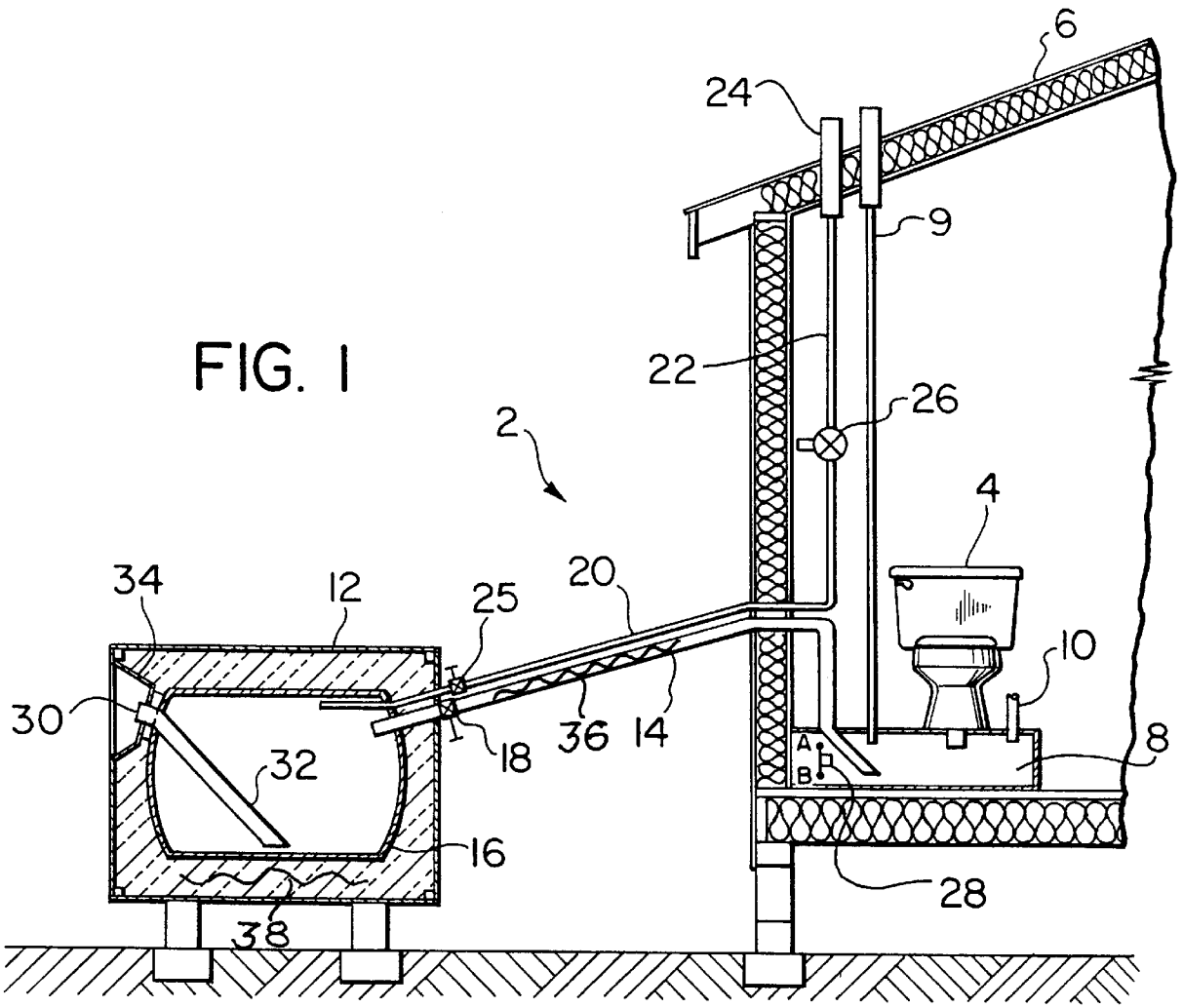
FIG. 1 is a schematic elevation view, from the side, of a sewage removal system in accordance with the present invention.

While the invention will be described in conjunction with an illustrated embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF THE PREFERRED EMBODIMENTS

Turning to FIG. 1 there is illustrated a sewage removal system 2 for a low water use toilet 4 within insulated building 6. System 2 comprises a transfer tank 8 positioned, as illustrated, below toilet 4 to collect sewage from that toilet. Other plumbing fixtures (not illustrated) may feed their effluents to transfer tank 8 through an appropriate inlet pipe 10. An appropriate vent 9 for transfer tank 8 may be provided as desired.

A holding tank 12, preferably insulated and positioned outside (as illustrated), or otherwise remote from building 6, is provided to collect sewage from transfer tank 8 and hold it for periodic removal by, for example, a vehicle drawn sewage haul tank (not illustrated). Holding tank 12 may be higher than, below or on a similar level to transfer tank 8. A sewage discharge pipe 14 extends from an inlet near the floor of transfer tank 8 to an outlet in an upper portion of the interior chamber 16 of holding tank 12 as illustrated. An important aspect of the invention is that pipe 14, between its inlet and outlet, rises to a point which is significantly above both the fluid levels of the transfer tank 8 and holding tank 12. In this way, any fluid within pipe 14, when the system is not in operation, will naturally drain, by gravity flow, into either transfer tank 8 or holding tank 12, avoiding the need for valve control in this pipe, during normal operation and clearing the pipe of sewage when not in use to avoid freezing (a very important feature for harsh northern climates). A fluid cutoff valve 18 may be provided at an appropriate position along sewage discharge pipe 14. As will be described in more detail later, this valve 18 remains open and inoperative during normal operation of system 2. It is closed only to enable pressurization of holding tank 12 for periodical removal of sewage from that tank.

From an upper portion of the interior chamber 16 of holding tank 12 a vent pipe 20 extends, as illustrated, a portion 22 of that pipe passing through the interior (insulated) space of building 6 to terminate in a vent discharge outlet 24. A cutoff valve 25 is provided at a convenient location in vent pipe 20 as illustrated. As with cutoff valve 18, cutoff valve 25 is not used during normal operation of system 2 while sewage is being transferred from transfer tank 8 to holding tank 12. (Where the holding tank is evacuated by a common suction process, valves 18 and 25 are not required.) This valve is normally in open position during such operation of system 2. It is only closed to enable pressurization of holding tank 12, as will be described in more detail hereinafter, for removal of sewage from that tank. A blower 26 is provided in portion 22 of vent pipe 20, and is of a construction and size so as, when activated, to create a sufficient vacuum within chamber 16 of holding tank 12 to draw sewage from transfer tank 8, through discharge pipe 14, into holding tank 12. Blower 26 is controlled by a sewage level control switch 28 positioned within transfer tank 8 as illustrated. The blower 26 cuts in when the sewage level in transfer tank 8 reaches a predetermined height (A) and cuts off when the sewage level within tank 8 falls to a lower, predetermined level (B).

Thus, it will be understood that system 2 uses a blower-created vacuum periodically to transfer sewage held in transfer tank 8 to holding tank 12. When the sewage level in transfer tank 8 reaches level (A), blower 26 is activated by means of sewage level control switch 28, thereby producing a temporary vacuum in chamber 16 of holding tank 12. This vacuum draws the sewage through pipe 14 from transfer tank 8 until level (B) is reached. At that point, the blower 26 is shut off by sewage level control switch 28, and the system stands still until the next cycle starts. Sewage remaining in pipe 14 when blower 26 becomes shutoff, is then free to fall by gravity into transfer tank 8, if it is in the proximal part of pipe 14 to transfer tank 8, or into holding tank 16 if it is in the proximal part of pipe 14 to tank 16. When the blower 26 is not activated, the vent pipes 20 and 22 function as a normal vent for the holding tank 12.

For removal of sewage from holding tank 12, an appropriate sewage outlet 30, at the upper end of pipe 32 within chamber 16, is provided for connection to a hose in a haul vehicle (not illustrated). Where that haul vehicle may, for example, pressurize chamber 16, for removal of sewage therefrom, then valves 18 and 25 may be used. After they have been closed and an appropriate air hose (not illustrated) associated with the haul vehicle is connected to air blower fitting 34. When the removal process has been completed, the air hose is removed from air blower fitting 34, depressurizing chamber 16, and valves 18 and 25 are opened to resume normal operation of system 2 for collection of sewage in holding tank 12.

To prevent freezing of sewage in pipe 14 or in holding tank 16, as illustrated in the figures, an appropriate heater means 36 and 38 respectively, which for example may be thermostat controlled electrical heater elements, may be associated with pipe 14 and holding tank 16.

Thus it is apparent that there has been provided in accordance with the invention a sewage removal system that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. An above-ground sewage removal system for a low water use toilet within a building, the system comprising an above-ground transfer tank to collect sewage by gravity from the toilet, a holding tank above-ground and remote from the transfer tank, a sewage discharge pipe extending between the transfer tank and the holding tank for fluid communication between the transfer tank and the holding tank, the sewage discharge pipe rising to a point, along its length, which is significantly above the fluid level in each of the transfer tank and the holding tank, a vent pipe for the interior of the holding tank and blower associated with the vent pipe, when activated to create a sufficient vacuum within the holding tank to draw sewage from the transfer tank, through the discharge pipe, into the holding tank, and switch means associated with the transfer tank and arranged so as to activate the blower, when the level of the sewage in the transfer tank rises to a predetermined height and to deactivate the blower when that level falls to a predetermined height.

2. A system according to claim 1 wherein the vent pipe is adapted to pass through the building, and the blower is adapted to be within the building.

3. A system according to claim 1 wherein the switch means is located within the transfer tank.

4. A system according to claim 2 wherein the switch means is located within the transfer tank.

5. A system according to claim 1 wherein the sewage discharge pipe extends from a position near a floor in the transfer tank to an elevated position within the holding tank.

6. A system according to claim 1 wherein the sewage discharge pipe is provided with a fluid cutoff valve.

7. A system according to claim 6 wherein the vent pipe is provided with a cutoff valve.

8. A system according to claim 1 wherein another plumbing fixture feeds to the transfer tank.

* * * * *